US007628026B1

(12) United States Patent
Kritsky et al.

(10) Patent No.: US 7,628,026 B1
(45) Date of Patent: Dec. 8, 2009

(54) PACKAGE TERMINAL AIR CONDITIONER SYSTEM AND ASSOCIATED METHODS

(76) Inventors: Walter Kritsky, 8003 Birman St., Maitland, FL (US) 32751; William Weinaug, 576 Heather Brite Cir., Apopka, FL (US) 32712; Robert L. Symmes, 136 Foxridge Run, Longwood, FL (US) 32750; Brian A. Mirus, 323 Raven Rock La., Longwood, FL (US) 32750

( * ) Notice: Subject to any disclaimer, the term of this patent is extended or adjusted under 35 U.S.C. 154(b) by 487 days.

(21) Appl. No.: 11/379,848

(22) Filed: Apr. 24, 2006

Related U.S. Application Data

(60) Provisional application No. 60/673,908, filed on Apr. 22, 2005.

(51) Int. Cl.
*F25B 5/02* (2006.01)

(52) U.S. Cl. ..... 62/200; 62/426

(58) Field of Classification Search ..... 62/89–90, 62/199–200, 426–429
See application file for complete search history.

(56) References Cited

U.S. PATENT DOCUMENTS 2,285,042 A * 6/1942 Macdonald, Jr. ..... 62/176.6
2,296,741 A * 9/1942 Sanders, Jr. ..... 62/175
2,304,269 A * 12/1942 McGrath ..... 62/176.5
4,281,522 A 8/1981 Bussjager
4,683,942 A 8/1987 Bierkamp et al.
5,346,127 A 9/1994 Creighton
5,404,938 A 4/1995 Dinh
5,622,057 A 4/1997 Bussjager et al.
5,992,160 A 11/1999 Bussjager et al.
6,089,464 A 7/2000 Morgan
6,109,044 A 8/2000 Porter et al.
6,698,219 B2 3/2004 Sekhar et al.

FOREIGN PATENT DOCUMENTS

JP 5106868 4/1993

* cited by examiner

*Primary Examiner*—William E Tapolcai
(74) *Attorney, Agent, or Firm*—Allen Dyer Doppelt Milbrath & Gilchrist

(57) ABSTRACT

An air conditioning unit is for cooling and dehumidifying outside air for flowing into an enclosed space from outside. The unit is interposable between a first evaporator coil and a first condenser coil and comprises a second evaporator coil that is positioned to receive outside air for channeling therethrough from an outer to an inner side and thence to the enclosed space. A second condenser coil is positioned to receive outside air for channeling therethrough from an inner to an outer side and thence to the outside. A compressor is in fluid communication with and upstream of the second condenser coil and downstream of the second evaporator coil. Another embodiment is intended as a unitary system and includes a unitary compressor and condenser coil, with one evaporator coil for processing inside air and another for channeling outside air into the enclosed space.

5 Claims, 5 Drawing Sheets

PACKAGE TERMINAL AIR CONDITIONER SYSTEM AND ASSOCIATED METHODS

CROSS-REFERENCE TO RELATED APPLICATION

This application claims priority to provisional application Ser. No. 60/673,908, filed on Apr. 22, 2005.

FIELD OF INVENTION

The present invention generally relates to air conditioning and handling systems and methods, and, in particular, to packaged terminal air conditioning systems and methods.

BACKGROUND

Packaged terminal air conditioning (PTAC) units are typically used for cooling air within a space. In a particular embodiment, PTACs can be used to provide space cooling for the hotel industry, which permits the occupant to control of his/her own cooling and heating requirements. PTACs are thermostatically controlled to maintain the desired temperature in the space but have no means to condition outside makeup air nor to maintain humidity levels within the space.

PTACs typically provide unconditioned outside air to hotel rooms or other spaces through an opening in the back of the unit. The air is introduced to the space at ambient outside air temperatures and is not conditioned in any way to prevent high moisture levels within the space. This results in the potential for mold and mildew growth within the space, a recurring problem within the HVAC and hotel/motel industries for many years, especially in areas of the world where high outdoor air humidity levels are common, such as the southeastern portion of the United States. Mold and mildew growth is further propagated by the use of constant exhaust systems such as are found in many hotel rooms.

In hotel rooms where the exhaust is intermittent, for a typical PTAC unit in the cooling mode with its evaporator fan and the exhaust fan off, the outside air is drawn into the space by the negative pressure created by the fan. In this the outside air is intermittent and does not meet the requirements of ASHRAE Standard 90.1 and many local building codes. Additionally, the air remains at the outside air temperature and humidity level.

In hotel rooms where the exhaust is constant, a typical PTAC unit, whether on or off, will introduce unconditioned outside air to the space on a continuous basis. While this mode of operation meets the intent of ASHRAE Standard 90.1 and local building codes, the air continues to be introduced to the space at the outside air temperature and humidity level.

Therefore, it would be desirable to provide a packaged terminal air conditioning unit that is capable of conditioning and dehumidifying outside makeup air introduced to the space served.

SUMMARY OF THE INVENTION

The present invention in a particular embodiment comprises a packaged terminal air conditioning (PTAC) unit that in a first embodiment includes a second refrigeration system positioned and configured to augment an existing PTAC unit. In a preferred embodiment, the air conditioning unit is for cooling and dehumidifying outside air for flowing into an enclosed space from outside the enclosed space. The unit is interposable between a first evaporator coil and fan and a first condenser coil and fan and comprises a second evaporator coil that is positioned to receive outside air for channeling therethrough from an outer side to an inner side and thence to the enclosed space. A second condenser coil is positioned to receive outside air for channeling therethrough from an inner side to an outer side and thence to the outside. A compressor is in fluid communication with and upstream of the second condenser coil and downstream of the second evaporator coil.

All appurtenances necessary for the second refrigeration system to operate properly are included. The objective is to provide a PTAC that constantly dehumidifies and conditions the outside makeup air.

The system is useful for the introduction of outside air through a PTAC unit by reducing the outside air temperature and humidity of the outside makeup air. In this case a separate controllable mechanism is provided for reducing the temperature of the outdoor air (sensible cooling) and dehumidifying the air (latent cooling) prior to entering the space.

The system has proved useful for ensuring that spaces served by PTAC units remain dry and substantially free of mold and mildew growth. The indoor air quality (IAQ) of the space is controlled with this invention. The system can be provided in a form that is compact, pre-assembled, and pre-manufactured and can be added to an existing or new PTAC unit.

Another embodiment of the system, which is intended for manufacturing de novo, comprises a condenser coil that is positioned to receive outside air for channeling therethrough from an inner side to an outer side and thence to the outside. A first evaporator coil is positioned to receive airflow from the enclosed space for channeling therethrough from an outer side to an inner side and thence to the enclosed space. A second evaporator coil is positioned to receive airflow from the outside for channeling therethrough from an outer side to an inner side and thence to the enclosed space. A compressor in fluid communication with the first and the second evaporator coil and the condenser coil is positioned for compressing refrigerant, for channeling the compressed refrigerant to the condenser coil and for receiving evaporated refrigerant from the first and the second evaporator coil.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENT

A description of the preferred embodiments of the present invention will now be presented with reference to FIGS. 1A-3C.

Figure 1A:
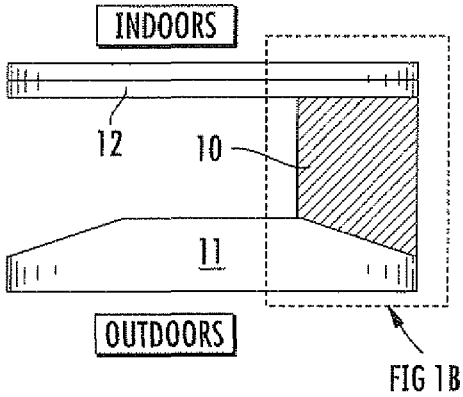
FIG. 1A is a schematic plan view of the positioning of a first embodiment of the refrigeration system of the present invention that conditions outside makeup air for a PTAC unit.

A first embodiment of a PTAC system 10 is illustrated in FIGS. 1A-1D. In FIG. 1A the unit 10 is shown as being positioned between the elements of an existing air conditioning unit comprising a condenser coil, fan, and shroud 11 on the inside and an evaporator coil 12 on the outside.

Figure 1B:
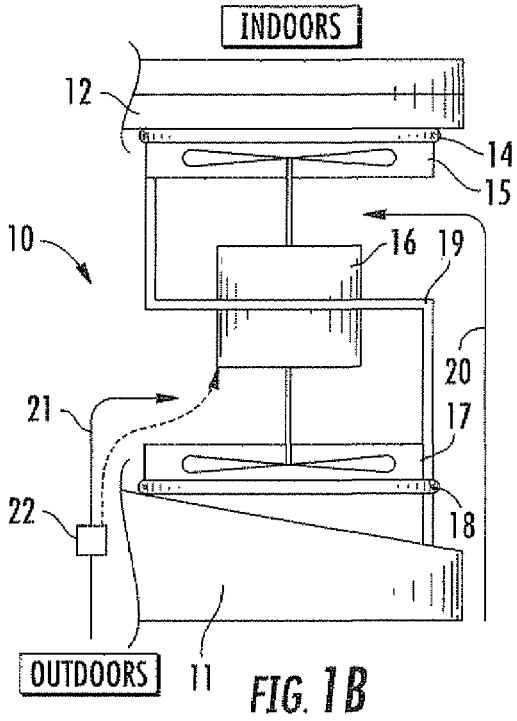
FIG. 1B is an enlarged plan view of the refrigeration system of the present invention positioned as in FIG. 1A.
Figure 1C:
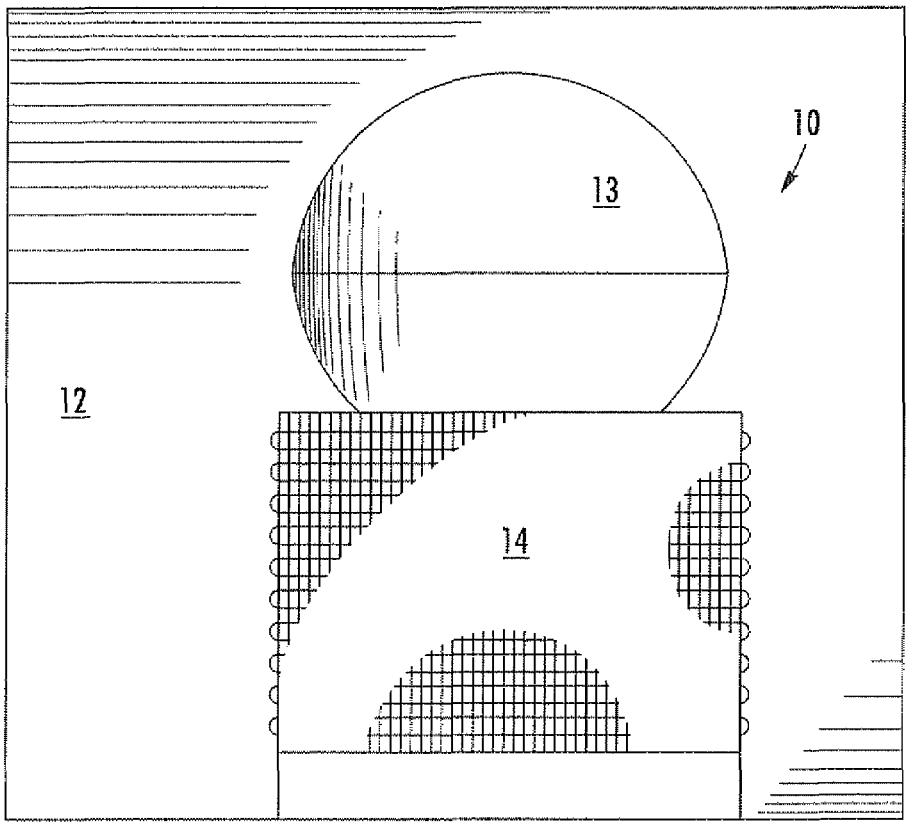
FIG. 1C is a schematic elevation of the refrigeration system of FIG. 1A.
Figure 1D:
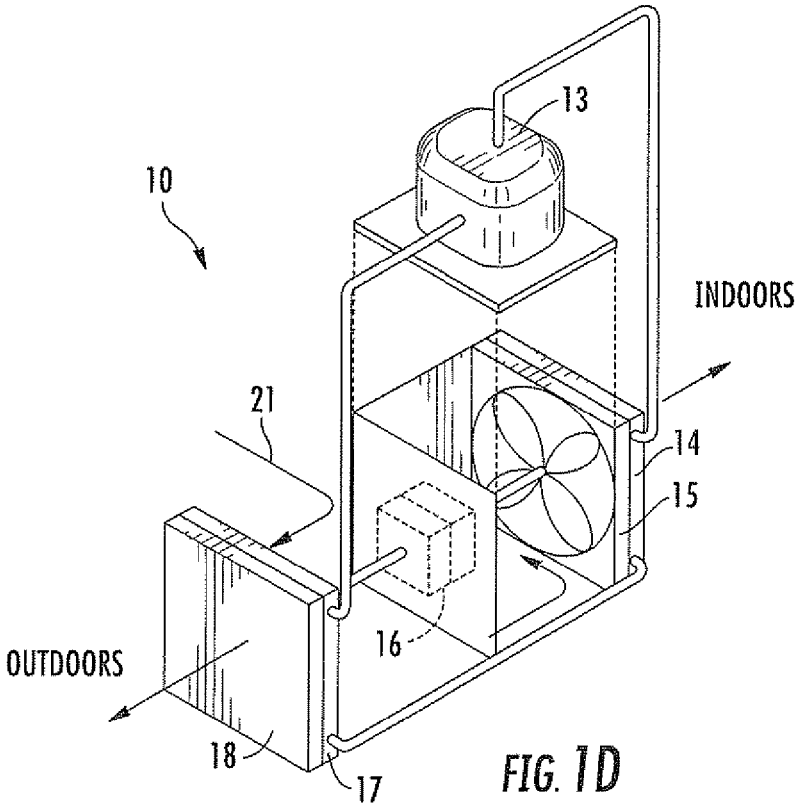
FIG. 1D is a schematic isometric view of the refrigeration system of FIG. 1A.

The area encompassing the unit 10 positioned as in FIG. 1A, as indicated by the dashed rectangle, is illustrated in plan view in FIG. 1B. An elevation view is given in FIG. 1C, and a schematic isometric view in FIG. 1D. The unit, connected together in conventional fashion, comprises a compressor 13, evaporator coil 14, evaporator fan 15, fan motor 16, condenser fan 17, and condenser coil 18. The evaporator coil 14 is mounted directly to the outside air opening in the existing PTAC unit 11,12, which typically comprises a 4×4 in. opening. A metal plate 19 is provided for air path separation adjacent the fan motor 16. The makeup air flow path 20 is shown to lead to the evaporator fan 15; the heat removal air flow path 21, to the condenser fan 17. Outside air is blown through the evaporator coil 14 by the evaporator fan 15 and then delivered directly to the indoor space. The system 10 preferably operates when the outside air temperature is 55° F./12.7° C. or higher, as monitored by a temperature sensor 22 in signal communication with the fan motor 16.

Figure 2:
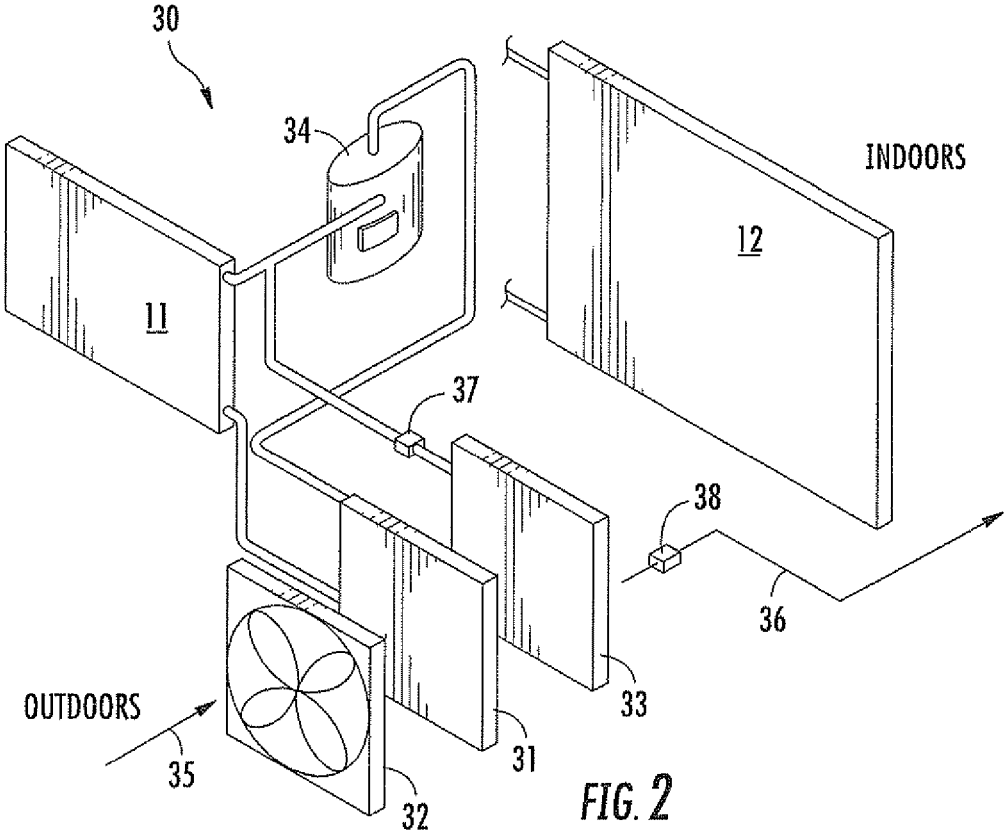
FIG. 2 is a schematic isometric view of a second embodiment of a refrigeration system that contains a hot gas reheat coil.

A second embodiment of a PTAC unit 30 is illustrated schematically in FIG. 2. In this embodiment 30 is included, adjacent the evaporator coil 31 and outdoor air fan 32, a hot gas reheat coil 33 downstream of the compressor 34 and of the evaporator coil 31. Outdoor air flow 35 enters the system 30, and conditioned air flow 36 enters the room.

The system 30 operates substantially as noted above but provides neutral air (75° F./23.8° C.—50% RH) to the space. The hot gas reheat coil 33 operates in conjunction with a temperature sensor 38 on the leaving side of the hot gas reheat coil 33. The sensor 38 operates a modulating refrigerant solenoid valve 37 that varies the flow of hot gas through the coil 33 to maintain the leaving air temperature. The remainder of the system 30 works substantially as described above.

Figure 3A:
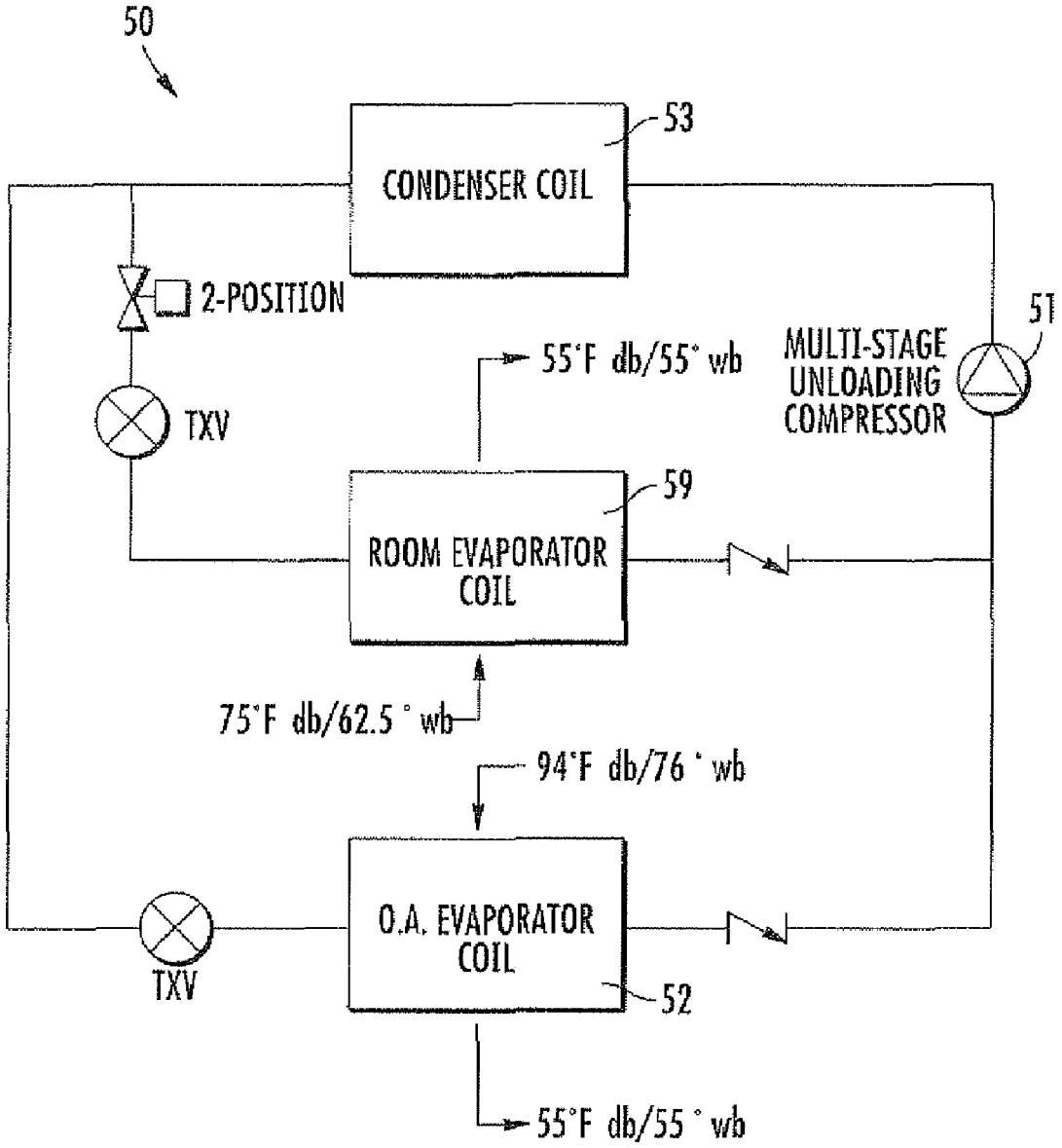
FIG. 3A is a schematic piping diagram of a third embodiment of a PTAC unit that contains a single multistage compressor for both refrigeration cycles, the PTAC unit, and the additional outside make up air evaporator coil.
Figure 3B:
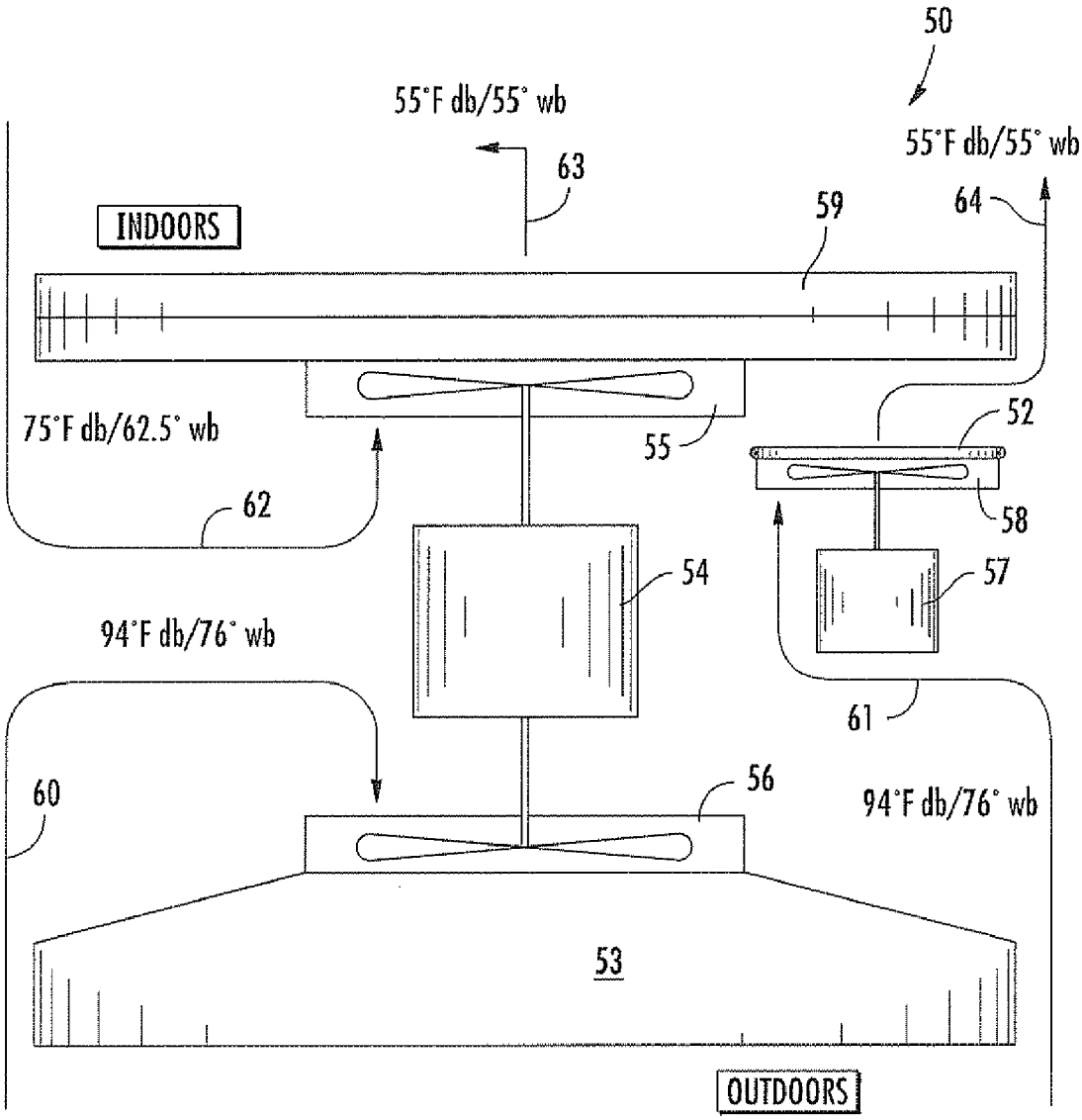
FIG. 3B is a schematic plan view of the PTAC unit of FIG. 3A.
Figure 3C:
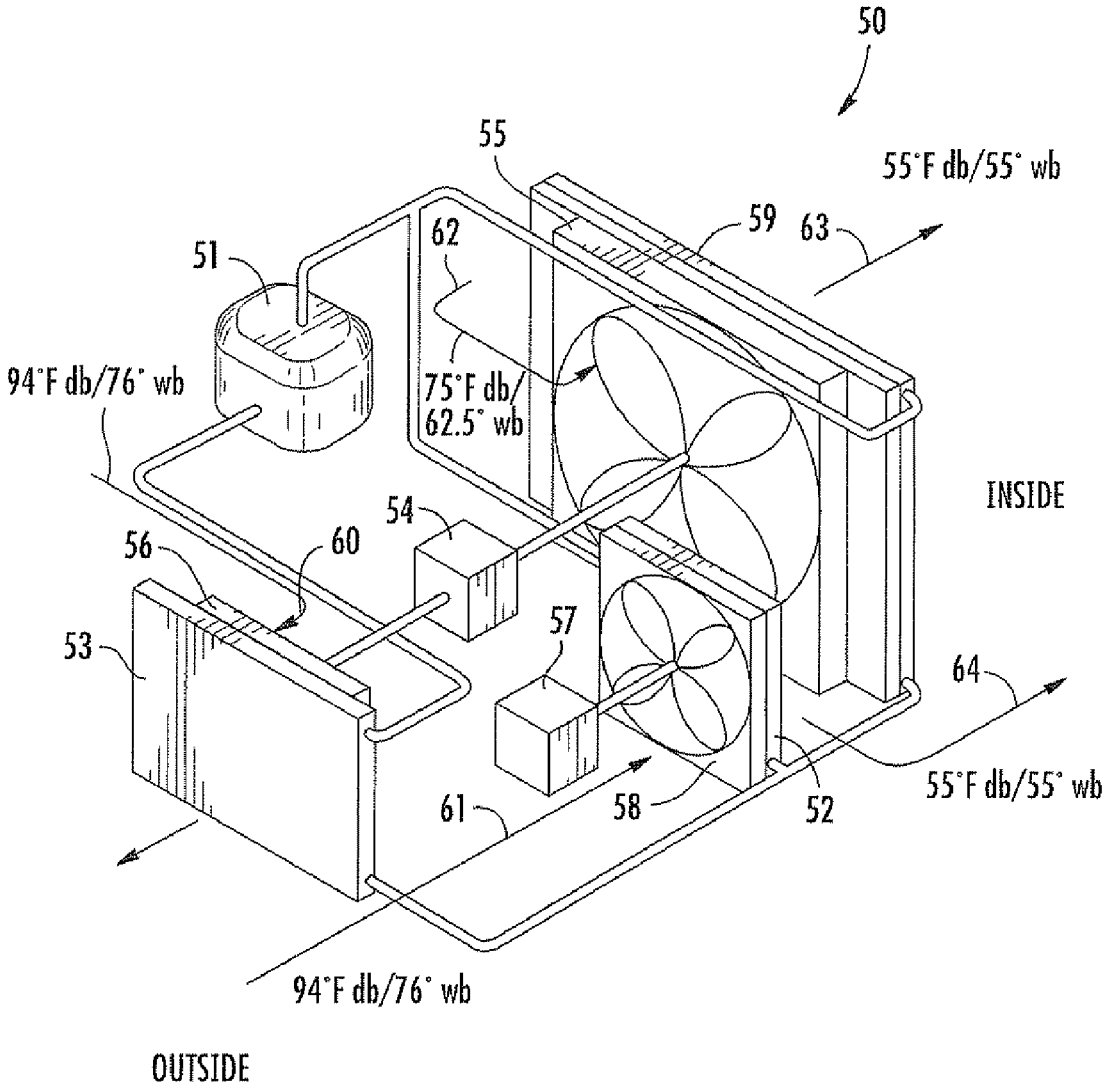
FIG. 3C is a schematic isometric view of the PTAC unit of FIG. 3A.

A third embodiment of a PTAC unit 50, illustrated in FIGS. 3A-3C, comprises a single compressor 51 at the heart of both refrigeration systems. This system 50 is believed to represent a preferable system to those 10,30 discussed above, which are intended for retrofit applications. The compressor 51 preferably comprises a multi-stage unloading compressor, which can maintain the PTAC's thermostat setting for the space and provide the required cooling-dehumidifying for the add-on evaporator coil 52. All heat rejection can be provided through a single condenser coil 53.

The system 50 further comprises a fan motor 54 for the evaporator fan 55 and condensor fan 56 and a fan motor 57 for the add-on evaporator coil fan 58. An evaporator coil 59 is provided adjacent the indoor face of the unit 50. Air flow 60 from the outside reaches the condenser coil 53 and fan 56; air flow 61 from the outside also reaches the add-on evaporator coil 52 and fan 58. Air flow 62 from indoors reaches the evaporator fan 55. Air flow 63 exits the evaporator 59 into the room, and air flow 64 exits the add-on evaporator coil 52 into the room. Exemplary temperatures, dry bulb and wet bulb, are given on FIGS. 3A-3C.

In the systems 10,30,50 discussed herein, outside air is conditioned by an independent air conditioning system that comprises a compressor, evaporator, condenser, evaporator fan, condenser fan, and all appurtenances necessary to make the refrigeration system operational such as capillary tube, thermal expansion device, and low-hi cut out switches. The outside air quantity (cfm) introduced should be adequate to meet the amount of exhaust air (cfm) in a typical hotel room or other space where the unit may be utilized.

The outside air flows through the evaporator coil by means of the evaporator fan and is cooled to approximately 55° F. (12.7° C.). The air is introduced to the space at approximately 65 grains of moisture per pound of dry air, as opposed to ambient outside air conditions. The outside air, as required by ASHRAE and local codes, is thereby continuously dehumidified prior to entering the space. The heat rejection from the refrigeration cycle leaves the system through the condenser coil and condenser fan mounted inside the PTAC unit.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A packaged terminal air conditioning (PTAC) unit comprising:

a condenser coil positioned to receive outside air for channeling therethrough and thence to the outside;

a first evaporator coil positioned to receive airflow from the enclosed space for channeling therethrough and thence to the enclosed space;

a second evaporator coil positioned to receive airflow from the outside for channeling therethrough and thence to the enclosed space; and a compressor in fluid communication with the first and the second evaporator coil and the condenser coil and positioned for compressing refrigerant, for channeling the compressed refrigerant to the condenser coil and for receiving evaporated refrigerant from the first and the second evaporator coil;

wherein the second evaporator coil is included in the PTAC unit interposed between the first evaporator coil and the condenser coil.

2. The packaged terminal air conditioning unit recited in claim 1, further comprising means for operating the second evaporator coil to continuously dehumidify the air flow from the outside prior to introduction to the enclosed space.

3. The packaged terminal air conditioning unit recited in claim 1, further comprising means for separating air flow entering the second evaporator fan and the second condenser fan from air flow entering the first evaporator fan and the first condenser fan.

4. The packaged terminal air conditioning unit recited in claim 2, wherein the means for operating the second evaporator coil to continuously dehumidify the air flow from the outside are adapted to reduce a moisture content to at least approximately 65 grains of moisture per pound of dry air.

5. The packaged terminal air conditioning unit recited in claim 2, wherein the means for operating the second evaporator coil to continuously dehumidify the air flow from the outside are adapted to reduce a moisture content corresponding to a wet bulb temperature of approximately 55 degrees.

* * * * *